US008636334B2

(12) United States Patent
Nishioka et al.

(10) Patent No.: US 8,636,334 B2
(45) Date of Patent: Jan. 28, 2014

(54) PRINTING APPARATUS AND ADJUSTMENT PATTERN PRINTING METHOD

(75) Inventors: Shingo Nishioka, Yokohama (JP); Akihiro Tomida, Kawasaki (JP); Yoshinori Nakajima, Yokohama (JP); Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/338,290

(22) Filed: Dec. 28, 2011

(65) Prior Publication Data

US 2012/0169810 A1 Jul. 5, 2012

(30) Foreign Application Priority Data

Jan. 5, 2011 (JP) ..... 2011-000628

(51) Int. Cl.
*B41J 29/393* (2006.01)
*B41J 2/21* (2006.01)

(52) U.S. Cl.
USPC ..... 347/19; 347/43

(58) Field of Classification Search
USPC ..... 347/43, 19
See application file for complete search history.

(56) References Cited

U.S. PATENT DOCUMENTS

| | | | | |
|---|---|---|---|---|
| 4,878,063 | A * | 10/1989 | Katerberg | 347/19 |
| 6,532,026 | B2 * | 3/2003 | Takahashi et al. | 347/41 |
| 7,429,094 | B2 * | 9/2008 | Hamasaki et al. | 347/41 |
| 2002/0135629 | A1 * | 9/2002 | Sarmast et al. | 347/19 |
| 2009/0237437 | A1 * | 9/2009 | Uchida | 347/16 |
| 2012/0044291 | A1 | 2/2012 | Kanematsu et al. | |

FOREIGN PATENT DOCUMENTS

JP 10-329381 A 12/1998

OTHER PUBLICATIONS

U.S. Appl. No. 13/351,392, filed Jan. 17, 2012.

* cited by examiner

*Primary Examiner* — Matthew Luu
*Assistant Examiner* — Alexander D Shenderov
(74) *Attorney, Agent, or Firm* — Fitzpatrick, Cella, Harper & Scinto

(57) ABSTRACT

The present invention provides an printing apparatus including a pattern printing unit for causing printing elements in partial regions of first and second printing element arrays to print adjustment patterns on a print medium, the adjustment patterns being for acquiring an amount of printing position shift of the second print head with respect to a printing position of the first print head, an acquisition unit for acquiring an amount of relative inclination between the first and second print element arrays, and a selection unit for selecting positions of the partial regions of the first and second printing element arrays based on the amount of relative inclination between the first and second print element arrays. As a result, consumption of media and ink upon a registration process and the amount of time required for the registration process can be reduced.

34 Claims, 18 Drawing Sheets

ELEMENT NUMBERS OF
ELEMENT GROUPS USED IN ADJUSTMENT

| | A1 | A2 |
|---|---|---|
| TOP SECTION | 1259 | 860 |
| CENTER SECTION | 839 | 440 |
| BOTTOM SECTION | 419 | 20 |

1601 1602

| | ADJUSTMENT PATTERNS | | CORRECTION PATTERNS | |
|---|---|---|---|---|
| | A1 | A2 | A1 | A2 |
| YELLOW | 1259 | 860 | 419 | 20 |
| MAGENTA | 839 | 440 | 839 | 440 |
| CYAN | 419 | 20 | 1259 | 860 |

FIG.16

PRINTING APPARATUS AND ADJUSTMENT PATTERN PRINTING METHOD

BACKGROUND OF THE INVENTION

1. Field of the Invention

The present invention relates to a printing apparatus such as a printer, and to an adjustment pattern printing method that is used for the printing apparatus.

2. Description of the Related Art

Japanese Patent Laid-Open No. H10-329381 (1998) discloses a process for adjusting a printing position of dots by inkjet printing (hereafter, this will also be referred to as a printing position adjustment process or registration process). More specifically, a "reference pattern" is printed by a reference nozzle array, after which a plurality of "shifted patterns", which are printed from a different nozzle array whose printing position is shifted a little at a time from the reference pattern, are printed over the reference pattern. Then based on the amount that the printing position of the shifted pattern is shifted and the position of the inflection point of the optical reflectivity, an amount of landing position error of ink droplets is calculated and the ejection timing that the print head ejects ink is corrected.

However, in the technology disclosed in the publication above, there is a problem in that a relatively large amount of media or ink is required for the registration process, and the processing time is long. There is also a need for a more precise registration process.

SUMMARY OF THE INVENTION

An object of the present invention is to provide a printing apparatus and an adjustment pattern printing method that is used for the printing apparatus that is able to reduce the amount of media and ink used, reduce the processing time and improve the adjustment precision when executing a registration process.

The present invention provides a printing apparatus for printing an image by moving a head unit with respect to a print medium, the head unit having first and second print heads being used for printing in a common area, the first print head having a first printing element array formed by a plurality of printing elements configured to print dots, the second print head having a second printing element array being arranged along with the first printing element array and being formed by a plurality of printing elements configured to print dots, including:

a pattern printing unit configured to cause a plurality of printing elements in a partial region of the first printing element array and a plurality of printing elements in a partial region of the second printing element array corresponding to the partial region of the first printing element array to print a plurality of adjustment patterns on a print medium, the plurality of adjustment patterns being for acquiring an amount of printing position shift (error) of the second print head with respect to a printing position of the first print head;

an acquisition unit configured to acquire an amount of relative inclination between the first and second print element arrays; and a selection unit configured to select positions of the partial regions of the first and second printing element arrays based on the amount of relative inclination between the first and second print element arrays.

With the present invention, it is possible to reduce consumption of media and ink upon a registration process, reduce the amount of time required for the registration process, and improve the adjustment precision.

Further features of the present invention will become apparent from the following description of exemplary embodiments (with reference to the attached drawings).

BRIEF DESCRIPTION OF THE DRAWINGS

FIG. 16 is a drawing that explains the position of pixel groups that are printed in adjustment patterns of a third embodiment of the present invention;

DESCRIPTION OF THE EMBODIMENTS

In the following, embodiments of the present invention will be explained in detail with reference to the accompanying drawings.

Figure 1:
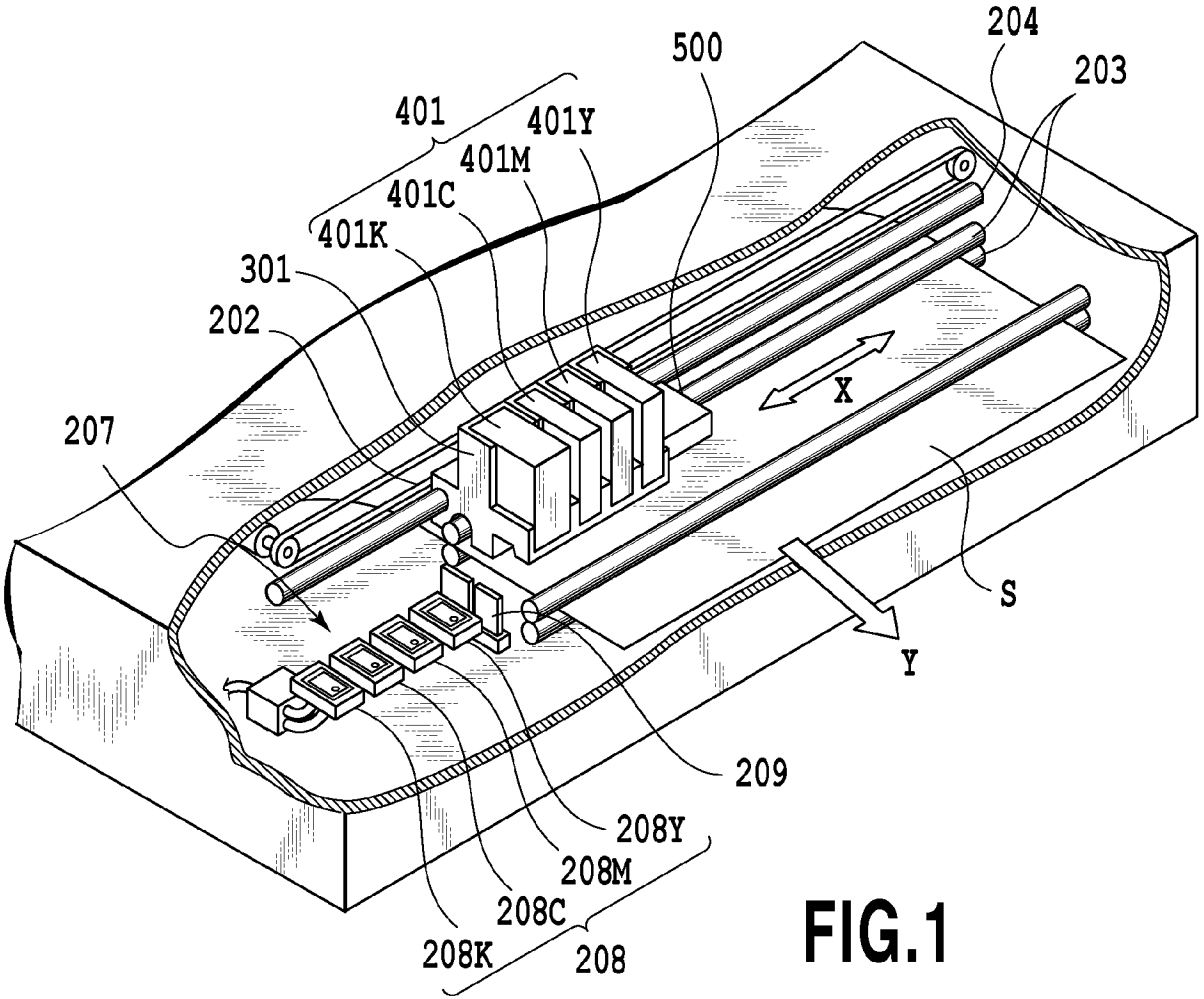
FIG. 1 is a perspective view illustrating an example of a printing apparatus to which the present invention is applied.

FIG. 1 is a perspective drawing that schematically illustrates the construction of the main parts of an inkjet printing apparatus to which the present invention is applied. In FIG. 1, a print head unit 401 moves back and forth in the scanning direction indicated by arrow X, and a print medium S such as typical printing paper, special paper, OHP film and the like is conveyed in the conveyance direction indicated by arrow Y that crosses the scanning direction (is orthogonal in this example) for each specified pitch. Ink is ejected from the ejection nozzles of the print head unit 401 according to printing data, and by repeatedly performing the scanning operation for moving the print head unit 401 back and forth, and the conveyance operation for conveying the print medium S, ink drops hit the print medium S to print an image that includes characters, symbols and the like.

The print head unit 401 comprises an electrothermal transducer and is an inkjet print head that ejects ink using thermal energy. The print head unit 401 prints an image by causing ink to be ejected from the ink ejection ports (nozzles) by utilizing the change in pressure that occurs when air bubbles are grown and contracted by film boiling due to thermal energy that is applied by the electrothermal transducer.

The print head unit 401 is mounted in a carriage 202 such that it is removable. The carriage 202 is supported such that it is can freely slide along a guide rail 204, and is moved back and forth along the guide rail 204 by a driving unit such as a motor (not illustrated in the figure). The print medium S is conveyed in the conveyance direction indicated by the arrow Y by conveyance rollers 203 such that a fixed interval is maintained between the print medium S and the surface of the ejection ports (surface formed by the ink ejection ports) of the print head unit 401.

The print head unit 401 comprises a plurality of print heads 401K, 401C, 401M and 401Y for discharging different inks, and respective nozzle arrays (ejection port arrays). Each nozzle array has 1280 printing elements arranged in the sub scanning direction at 1200 dpi spacing. In this example, the print heads are capable of discharging black (K), cyan (C), magenta (M) and yellow (Y) ink. Each print head is integrated with an ink cartridge for supplying the ink (black, cyan, magenta and yellow ink) to be ejected. The nozzles corresponding to the plurality of print heads 401K 401C, 401M and 401Y are used for printing dots in a common area of the print medium.

A recovery unit 207 is provided that faces the surface of the ink ejection ports of the print head unit 401 when the print head unit 401 moves to a non-printing area, which is an area within the range of back-and-forth movement of the print head unit 401, however is outside of the range where the print medium passes. This recovery unit 207 comprises a cap 208 (caps 208K 208C, 208M, 208Y) that can cap the ejection ports of the print head unit 401. The caps 208K, 208C, 208M and 208Y can cap the respective ejection ports that eject black, cyan, magenta and yellow ink. A suction pump is connected to the inside of the cap 208. By applying a negative pressure to the inside of the cap 208 when the cap 208 is capping the ejection ports of the print head unit 401, it possible to suck the ink from the ejection ports of the print head unit 401 into the cap 208. By performing this kind of suction recovery operation, it is possible to maintain the ink ejection performance of the print head unit 401.

The recovery unit 207 also comprises a wiper 209 such as a rubber blade for wiping the ejection port surface of the print head unit 401. By ejecting ink from the print head unit 401 toward the cap 208, it is possible to perform a recovery process (also called "preliminary ejection") to maintain the ink ejection performance of the print head unit 401.

Figure 2:
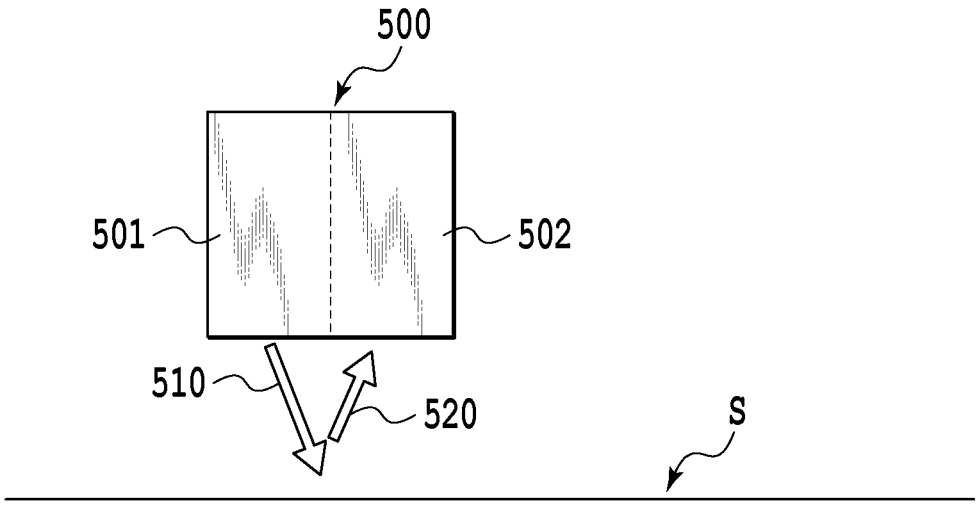
FIG. 2 is an explanatory view of an optical sensor.

A reflective optical sensor 500 as illustrated in FIG. 2 is provided in the carriage unit 2. There is an LED installed in a light-emitting unit 501, and the light 510 that is emitted by that LED is irradiated onto the print medium S. The light 520 that is reflected by the print medium S is incident on the light-receiving unit 502, and converted to an electrical signal by a photo diode.

This optical sensor 500 measures the printing density of the registration adjustment pattern that is printed on the print medium. By alternately conveying the print medium in the sub scanning direction and moving the carriage unit 2, in which the optical sensor is installed, in the main scanning direction, it is possible to detect the density of an adjustment pattern group that is printed on the print medium.

In the registration process of the embodiments, first a plurality of adjustment patterns are printed on a print medium. Each adjustment pattern comprises a first pattern and a second pattern; however, the relative printing position of the second pattern with respect to the first pattern is different.

Figure 3:
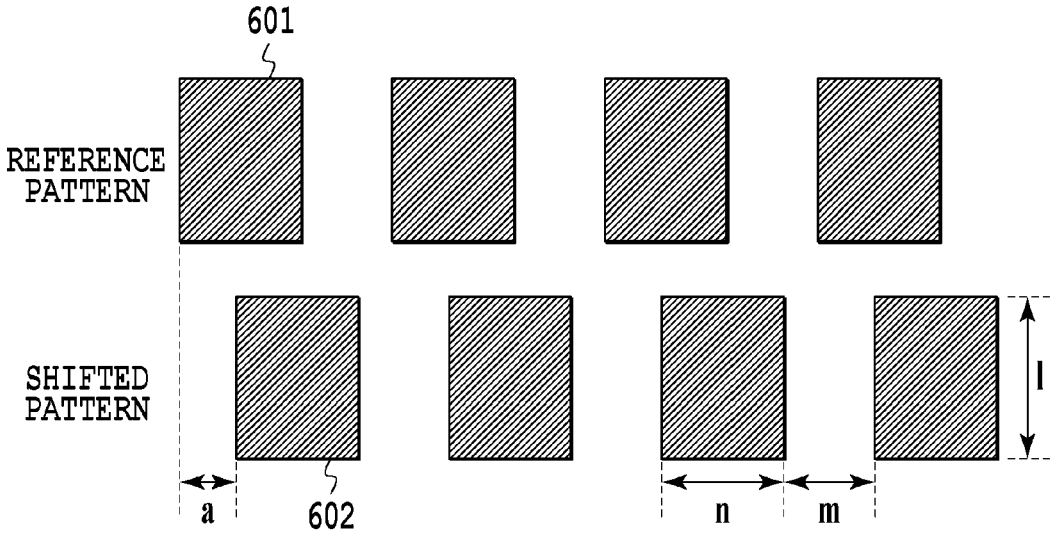
FIG. 3 is a view illustrating a configuration of a registration adjustment pattern whose density is detected by the optical sensor.

FIG. 3 illustrates the adjustment patterns that are used in a registration adjustment method that uses the optical sensor 500 installed in the printing apparatus to detect the density of the adjustment patterns and calculate the adjustment amount.

The adjustment patterns illustrated in FIG. 3 are configured such that a rectangular shaped pattern that is 1 pixel×n pixels is periodically repeated after an empty area of m pixels. The printing position of a shifted pattern 602, which is the second pattern, is set such that it is shifted a certain number of pixels 'a' with respect to a reference pattern 601, which is the first pattern. The resolution and unit of shift of the adjustment pattern is set according to the printing resolution of the printing apparatus. In this embodiment, the printing resolution is taken to be 1200 dpi.

Figure 4:
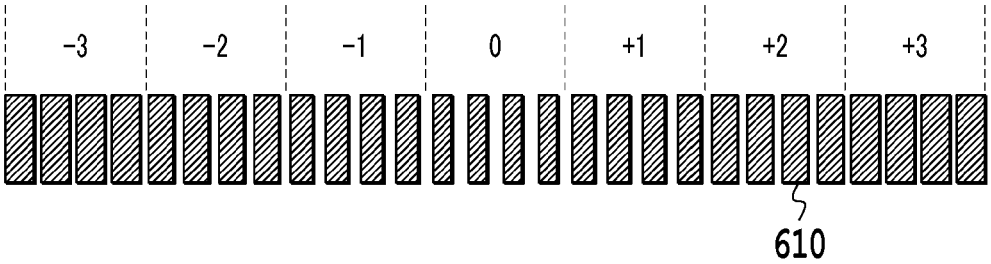
FIG. 4 is an explanatory view of registration adjustment patterns whose density is detected by the optical sensor detects density.
Figure 5:
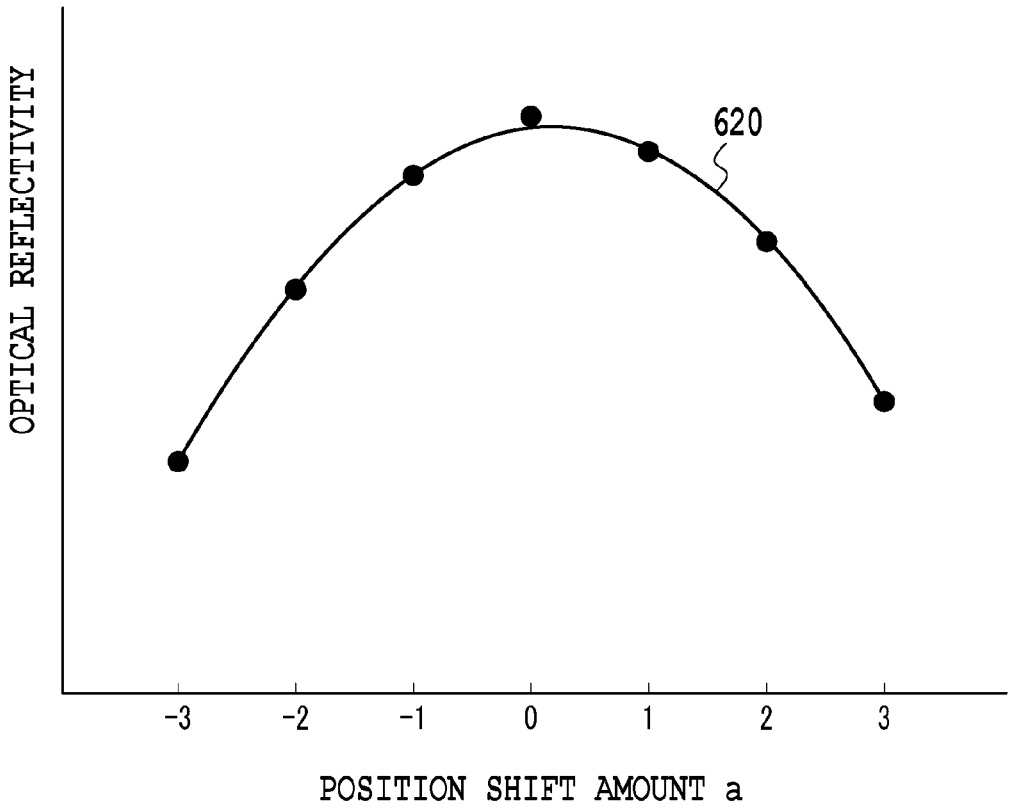
FIG. 5 is a graph showing the density detected from the registration adjustment pattern and its approximation curve.

In FIG. 4, a plurality of the adjustment patterns of FIG. 3 are arranged and printed such that the shift amount 'a' of the shifted pattern is changed from −3 pixels to +3 pixels. A change of an amount of printing position shift between two patterns changes results in a change of the area ratio that the ink occupies on the print medium. Therefore, as illustrated in FIG. 5, as the amount of pattern position shift becomes less, the optical reflectivity becomes higher. This means that in order to align the printing positions of two nozzle arrays to each other, the ejection timing should be adjusted by an amount of shift that will cause the optical reflectivity of the adjustment pattern to be a maximum. The number of adjustment patterns or the number of elements of the adjustment patterns can be set according to the shift units of the relative printing positions required for satisfying the desired precision for the registration process, or according to an adjustment range that is required by the mechanical tolerances of the device. The printing area of the adjustment patterns can be optimized with respect to the dimensions and the adjustment throughput of the print medium that is used for printing of the adjustment patterns based on the size of the detection area of the optical sensor, the width of the area that can be printed in one printing scan, the size of the printable area of the print medium with respect to the adjustment pattern group, and the like.

Figure 6:
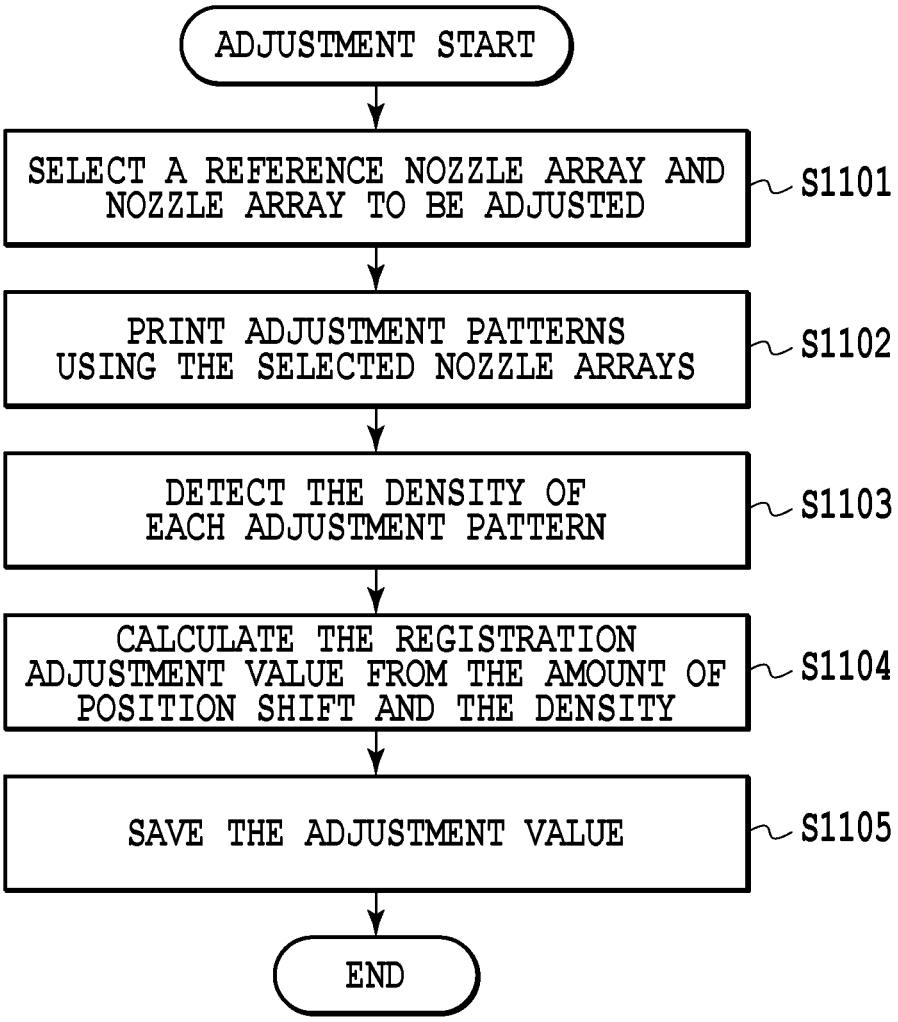
FIG. 6 is a flowchart illustrating a flow of a registration adjustment method in case where the density of the registration adjustment pattern is detected by the optical sensor.

FIG. 6 is a flowchart of the method for calculating the registration adjustment value from the adjustment patterns above. In step S1101, a nozzle array that will be a reference and the nozzle array for which adjustment will be performed are selected, and in step S1102, adjustment patterns are printed for each of the selected nozzle arrays. During bi-directional registration adjustment, a nozzle array is selected for which adjustment is to be performed, reference patterns 601 are printed in the forward direction or backward direction, and the shifted patterns 602 are printed in the other direction. After that, in step S1103, the optical sensor is used to read the density of the adjustment patterns 610. As illustrated in FIG. 6, the density read by the optical sensor is obtained as the optical reflectivity with respect to the shift amount 'a', and an approximation curve 620 is calculated from the change in that optical reflectivity. Based on that approximation curve, the shift amount 'a' is set in step S1104 so that a position shift between the reference pattern and the shifted pattern is a minimum, and the registration adjustment value is calculated. Here, the registration adjustment resolution is 4800 dpi, and the registration adjustment value is calculated in 4800 dpi units. The registration adjustment value that is obtained in this way is stored in step S1105 in a memory area of the printing apparatus.

The printing element arrays that are used for forming the reference patterns and shifted patterns are set to correspond with the combination of the ink color or scanning direction that will be the adjustment target. First, the printing element array that will be for the reference is set and reference patterns are formed, then the shifted patterns are formed using the other printing element arrays. In the case of performing position adjustment between different colors, the printing element array that prints black forms the reference pattern, for example, and the printing element arrays for the colors cyan, magenta and yellow form the shifted patterns.

Figure 7:
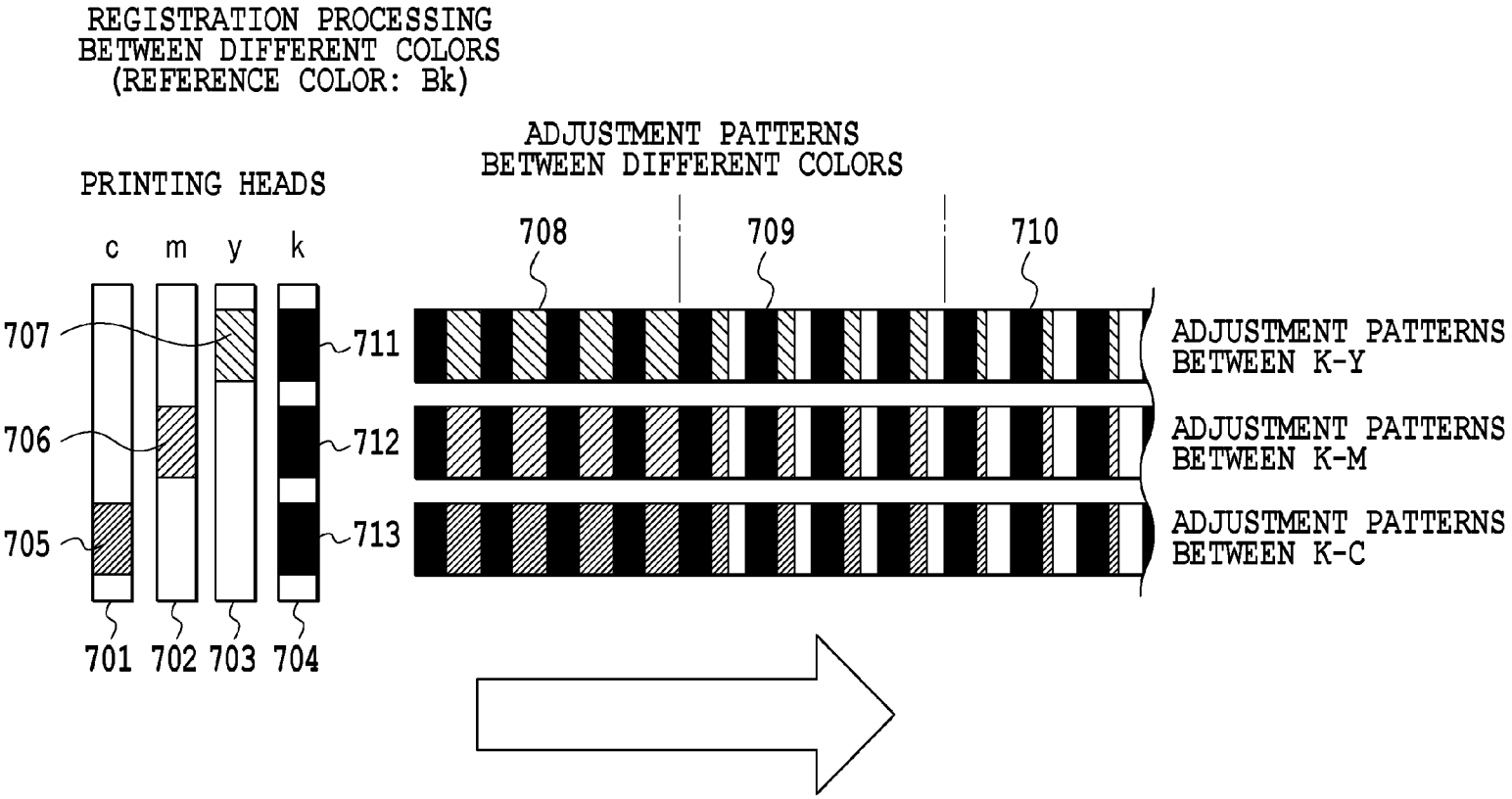
FIG. 7 is a view for explaining an adjustment pattern printing method including performing a registration process.

In this embodiment, when forming a pattern, in order to conserve the amount of ink and printing paper used, and to reduce the processing time, patterns as illustrated in FIG. 7 are printed.

In FIG. 7, reference numbers 701, 702, 703 and 704 indicate the print heads for cyan, magenta, yellow and black, respectively. These print heads are provided to the print head unit 401 as an independent chip, respectively. The adjustment patterns are printed using these print heads. Each of the print heads has the same number of printing elements, and those printing elements are arranged along the entire length of the print head.

Here, for example, the case of using the black print head 704 as a reference, and adjusting the printing position of the print heads 701, 702 and 703 of the other three colors was explained; however, any of the colors could be taken to be the reference.

The print heads scan in the direction of the arrow in FIG. 7, and by using part of the plurality of printing elements of each of the print heads, adjustment patterns between black and yellow (K-Y), between black and magenta (K-M) and between black and cyan (K-C) are printed. In other words, the black print head (first print head) uses the printing elements of the three areas 711, 712 and 713 that correspond to the colors Y, M and C, and the print heads of the other colors (second print heads) use the printing elements of part of the areas 705, 706 and 707.

Each adjustment pattern comprises a plurality of patterns 708 709, 710 and so on that have different shift amounts between the black reference pattern and the shifted patterns of the other colors. When doing this, it is necessary that the size of an adjustment pattern be a size such that change in density is visibly noticeable, or be a size such that the change in density can be detected when compared with the spot diameter of the sensor.

As illustrated in FIG. 7, when adjustment patterns are formed between each of the different colors using printing elements of part of the areas of each print head, it is possible in one scan (movement) to print a plurality of adjustment patterns having the necessary size, making it possible to reduce the amount of media consumption used in the registration process and shorten the adjustment time.

However, when relative inclination occurs between two print heads, there is a possibility that the printing position cannot be properly adjusted by the adjustment method illustrated in FIG. 7.

Figure 8:
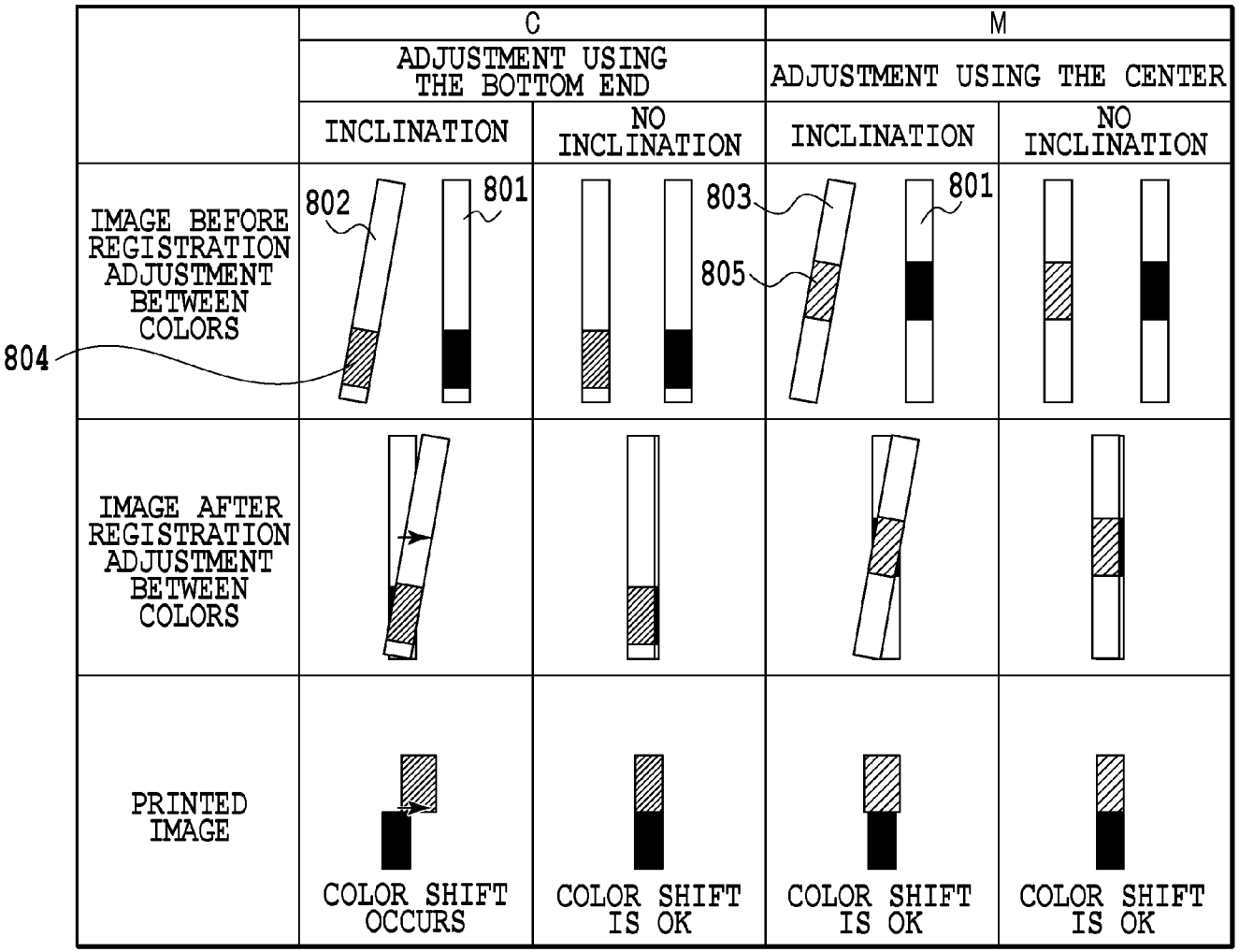
FIG. 8 is an explanatory view for illustrating a printing position shift generated depending on a position of element groups for printing adjustment patterns and an inclination of a print head.

Here, referring to FIG. 8, the problem in the case when relative inclination occurs between two print heads is explained. In FIG. 8, reference numbers 802 and 803 indicate the print heads for cyan and magenta, respectively, and 801 indicates the print head for the reference color black. FIG. 8 illustrates an example of performing printing position adjustment for magenta (M) using the printing elements for the center area 805 of the print head 803, and for cyan (C) using the printing elements of the lower area 804 of the print head 802. The upstream side of the sub scanning direction (conveyance direction of the print medium) is taken to be the top end of the print head, and the downstream side is taken to be the bottom end.

Here, printing position adjustment by the printing apparatus is performed so that printing positions of the center regions of two print heads are aligned. Therefore, when printing is performed using all of the printing elements after printing position adjustment has been performed for magenta (M), regardless of whether or not there is relative inclination between the print head 801 for the reference color black and the print head 803 for magenta, there is no printing position shift between black and magenta. In other words, when the printing position shift is defined as a position shift between center positions of two line segments that are printed by two print heads, the center positions of two line segments that are printed by printing elements in the center regions of two print heads match and no printing position shift occurs.

On the other hand, when relative inclination does not occur between print heads for cyan (C), the center positions of the two print heads are aligned to each other even though printing position adjustment is performed using printing elements in the bottom end region of the print heads, so that no printing position shift occurs. However, when relative inclination occurs between print heads, the center positions of the two print heads are not aligned to each other by a printing position adjustment using only the printing elements in the bottom end region of the print heads, and the printing position shift occurs. For this reason, even when the same inclination occurs for magenta (M) and cyan (C), there is a possibility that color shift of cyan (C) will become large. In other words, even when the amount of inclination of the print heads is the same, the color shift amount becomes different depending on positions of printing elements used for printing position adjustment. In the following, an arrangement for solving this problem will be described in detail.

Embodiment 1

In the present embodiment, the case of correcting the adjustment value for adjusting the printing position according to an inclination amount of the print heads and the position of the printing elements used for printing the patterns for a printing position adjustment will be explained.

Figure 9B:
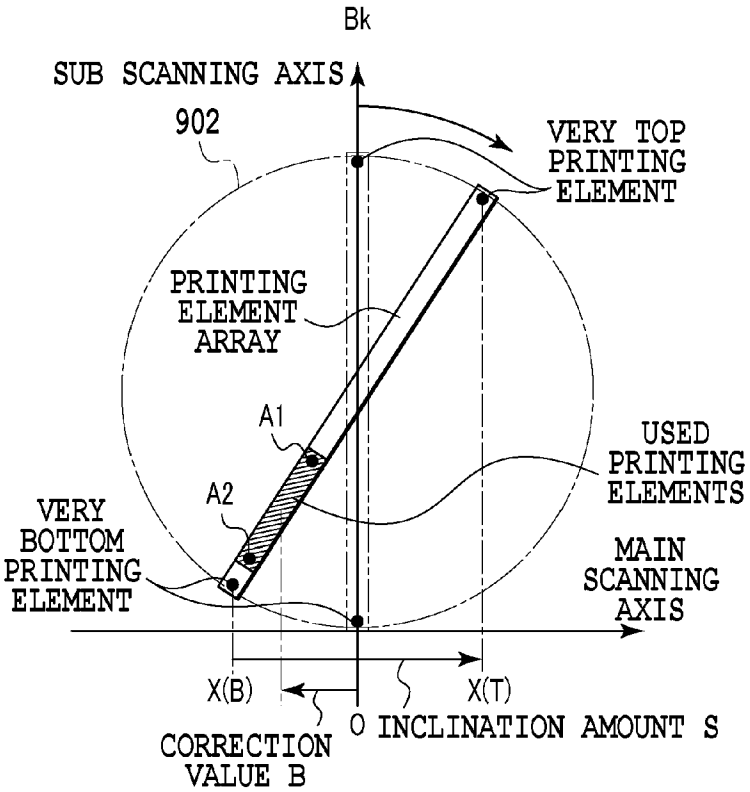
FIGS. 9A and 9B are explanatory views for illustrating amounts of printing position shift generated depending on position of an element group for printing adjustment patterns and an inclination of the print head.
Figure 9A:
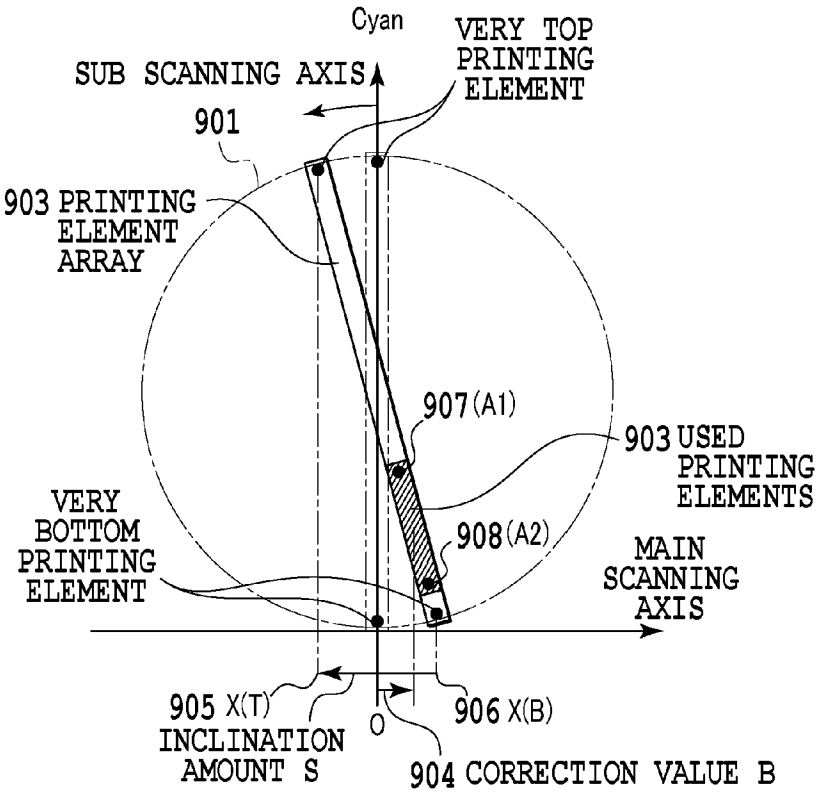

FIG. 9A and FIG. 9B are drawings that illustrate in detail the effects that inclination has on the adjustment value during printing position adjustment between black and cyan when inclination occurs in the print heads. The upstream side of the sub scanning direction of the printing element arrays (conveyance direction of the print medium) is taken to be the topside of the printing element array, and the downstream side is taken to be the bottom side. The printing element arrays are also taken to have 1280 printing elements.

In the figures, reference number 901 illustrates the printing elements that print a pattern for performing printing position adjustment for the cyan print head, and illustrates how much the position of the printing elements separate from the center (reference position) due to inclination of the print head. Reference number 902 illustrates the same for the black print head. Reference number 903 indicates the used printing elements that are used for printing a pattern, 907 indicates the printing elements on the top end of the used printing elements 903, and 908 indicates the printing elements on the bottom end of the used printing elements 903, where the element numbers (position shift information from the reference position of the printing elements) are taken to be $A_1$ and $A_2$ ($A_1>A_2$). The results of performing adjustment uniformly receive the effects of the printing elements used for adjustments, so that the value 904 obtained by projecting the center position between $A_1$ and $A_2$ in the printing element array onto the main scanning axis (correction value B) is the amount of shift of the used printing elements 903 from the center of the print head. The point on the main scanning axis where the very top printing element position of the printing element array is projected is taken to be 905 (X(T)), and the point on the main scanning axis where the very bottom printing element position of the printing element array is projected is taken to be 906 (X(B)). The point where the main scanning axis in FIG. 9A and FIG. 9B crosses the sub scanning axis is taken to be zero, with positive numbers being on the right side and negative numbers being on the left side. X(T) and −X(B) at this time are defined as the inclination amount S of the printing element array, and when this printing element array is not inclined, S=0. When the printing element array is inclined, S≠0, and the direction of the inclination (direction of rotation) can be identified by whether S is a negative number (S<0) or a positive number (S>0).

Figure 10:
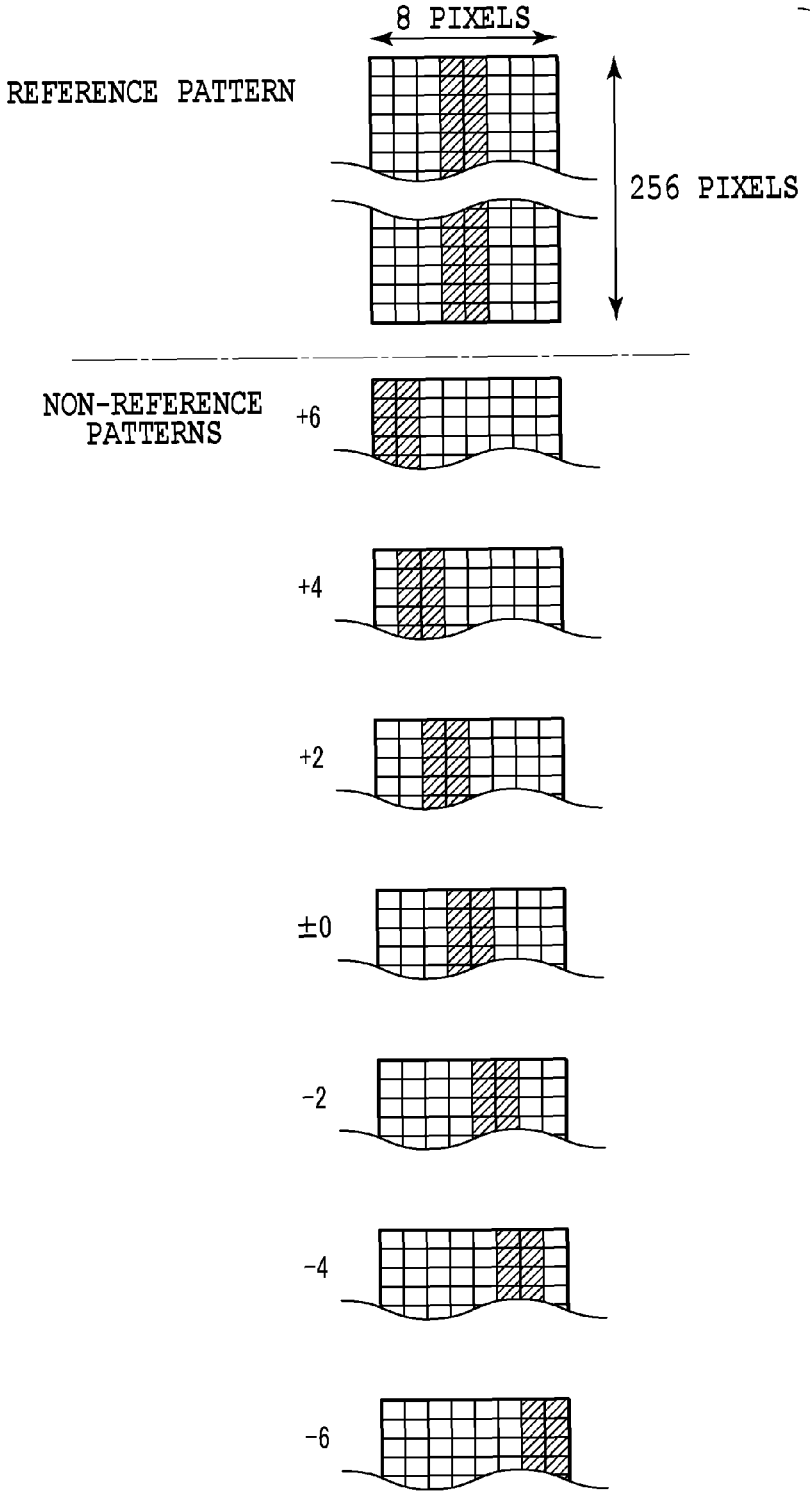
FIG. 10 is a view for illustrating an example of patterns for detecting an amount of an inclination of the print head.

Here, the method for finding the inclination amount S of a print head will be explained in detail. An example of printing patterns for acquiring the inclination amount S is illustrated in FIG. 10. Each pattern has a size of 256 pixels (vertical) by 8 pixels (horizontal) (for both vertical and horizontal, 1200 dpi units). The vertical direction corresponds to the sub scanning direction, and the horizontal direction corresponds to the main scanning direction. The reference pattern is made so that dots are printed in the center two pixels of the 8 horizontal pixels for a 256-pixel vertical length. Seven non-reference patterns are prepared so that the position of a two pixel width line having a 256 pixel vertical length moves from the left end of the 8 horizontal pixels one pixel at a time toward the right end, and the values of the patterns in order +6, +4, +2, ±0, −2, −4, and −6 correspond to the numerical values representing the inclination amount S.

Figure 11A:
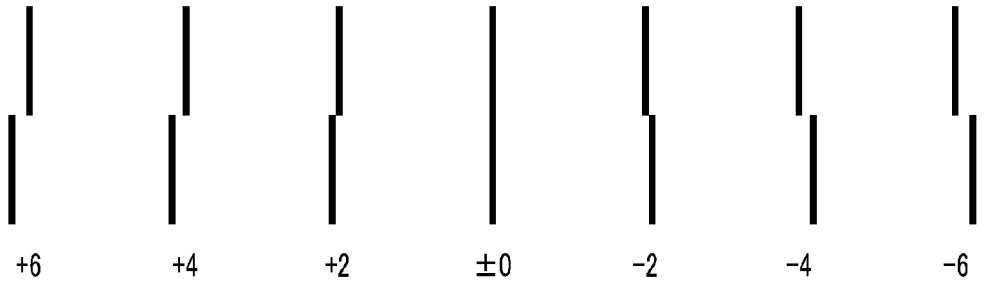
FIGS. 11A and 11B are views for illustrating an example of patterns for detecting an amount of inclination of the print head.
Figure 11B:
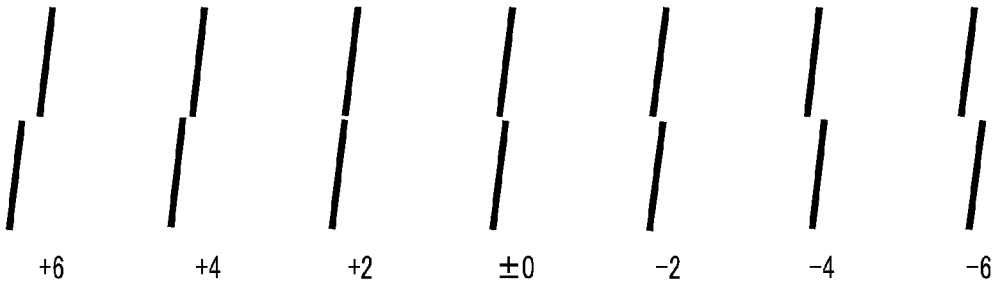

First, a reference pattern is printed on the print medium using the 256 printing elements of the very bottom area of the printing element array for which the inclination amount S is to be obtained. After that, the print head on which that printing element array is mounted is moved relative to the print medium in the sub scanning direction a distance that is the same as the length in the element arrangement direction of the printing element array (approximately one inch in this embodiment). Then, the 256 printing elements on the very top of the printing element array are used to print one non-reference pattern (+6) on the print medium. Similarly, that printing element array is used to print in parallel combinations of the reference pattern and non-reference pattern for the other non-reference patterns, so that seven vertical line patterns are printed on the print medium as illustrated in FIG. 11A and FIG. 11B. The user is able to quantitatively acquire the inclination amount S of the targeted printing element array in question by looking at the seven vertical line patterns, and selecting a line pattern for which the printed reference pattern and non-reference pattern are connected in a straight line.

FIG. 11A are printing patterns for the case in which there is hardly any inclination of the printing element array, and when looking at where the non-reference pattern is the same image as the reference pattern (±0), it can be seen that the line patterns are connected in nearly a straight line. On the other hand, in the case where the printing element array is inclined, the line patterns are connected in a straight line for a combination with a pattern other than the non-reference pattern (±0) as illustrated in FIG. 11B. In the example in FIG. 11B, the line patterns are connected in nearly a straight line for a combination with the non-reference pattern (+2), so the inclination amount of that printing element array can be determined to be "+2". The printing patterns in this embodiment have a main scanning resolution of 1200 dpi, so that for an inclination amount of "+2", the inclination amount has a length of approximately 42 μm. In the case when looking at the printed line patterns it is determined that the inclination amount is on mid between "+2" and "+4", it is possible for the inclination amount S to take on the middle value of "+3". In other words, in this embodiment, the inclination amount S can be obtained in 2400 dpi units.

The inclination amount S that was obtained is stored in a memory medium through user input to the printing apparatus or the like. Here, the inclination amounts S for the black, cyan, magenta and yellow printing element arrays are taken to be S(i) (i=K, C, M, Y) respectively.

The printing patterns above are an example, and variations are possible such as increasing the output resolution in order to improve the detection precision of the inclination amount, increasing the horizontal size of the printing patterns in order to increase the selected width of the inclination amount, or increasing the number (types) of non-reference patterns. Moreover, changes are possible such as increasing the vertical size of the printing patterns (lengthening the line patterns) in order to improve the visibility of the printed line patterns, or increasing the width of the lines to more than two dots. On the other hand, when the number of printing elements of each printing element array is less than 256 elements, it is necessary to change the image according to the conditions such as reducing the vertical size of the printing pattern.

As a method for obtaining the inclination amount S of the printing element array, is a method of printing a plurality of overlapping adjustment patterns while gradually changing the printing timing of the very top printing element group with respect to printing of the very bottom printing element array, which is the reference, and then determining the density using a sensor or the like.

Next, a method is explained for finding the amount that the adjustment value, which is obtained when printing patterns are printed using a position other than the center of the print heads with inclination occurring in the print heads, is shifted from the adjustment value of the printing position that was originally supposed to be found, or in other words the correction amount. The correction value B can be expressed by Equation 1 below.

$$B(i) = \frac{(A_1 - A_2)/2 + 639.5 - A_1}{1279} \times S(i) \quad (i = K, C, M, Y) \qquad \text{Equation 1}$$

This correction value B can be found respectively for black and cyan. Here, black is taken to be the reference element array, so that by taking the adjustment value for cyan with respect to black that was adjusted using the bottom area of the printing element array before correction is performed to be P(C), Equation 2 for finding the corrected adjustment value P'(C) is as given below.

$$P'_{(C)} = P_{(C)} - 2(B_{(K)} - B_{(C)}) \qquad \text{Equation 2}$$

By correcting the printing adjustment value P using the correction value B in this way, a more suitable adjustment value is obtained.

Figure 12:
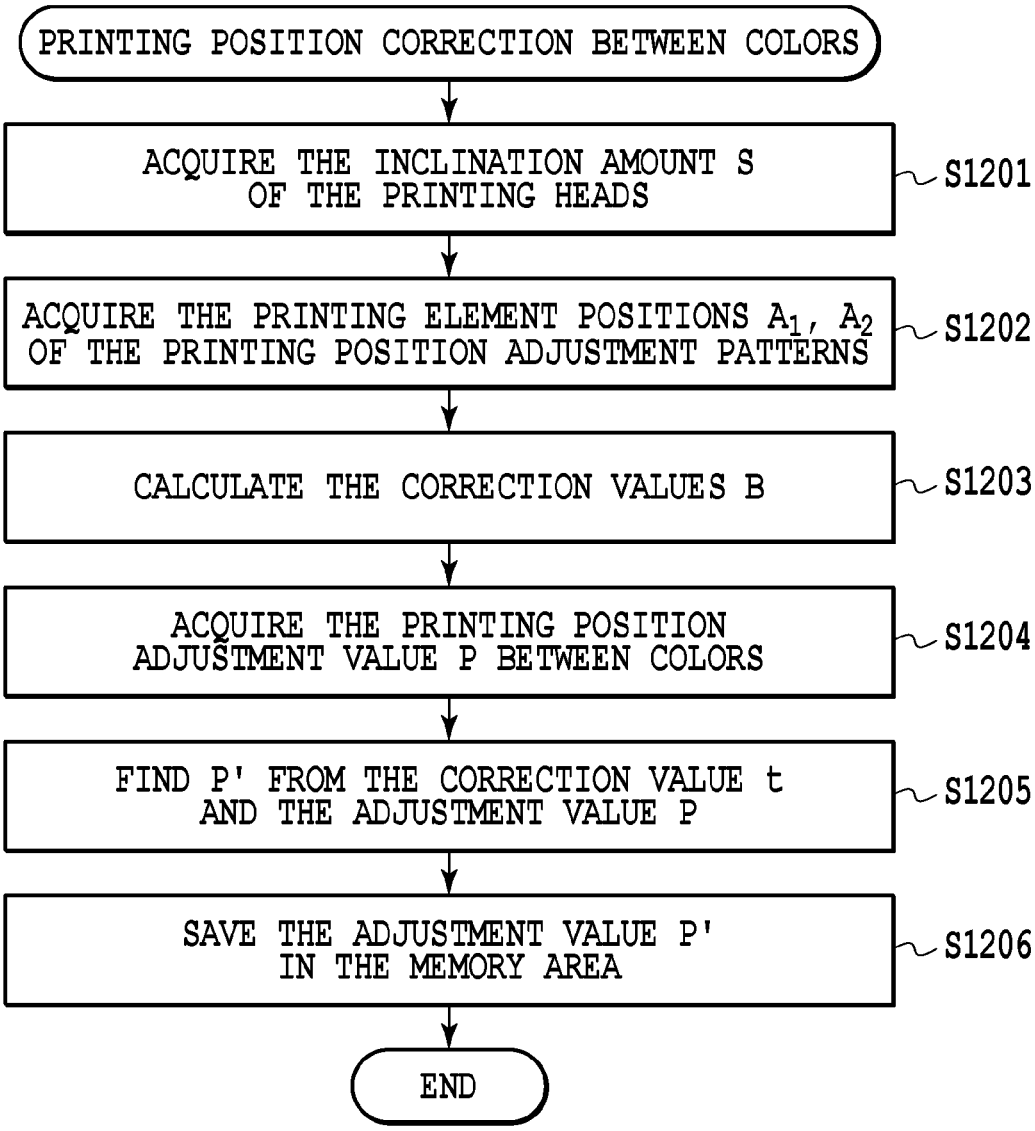
FIG. 12 is a flowchart for illustrating the processing according to a first embodiment of the present invention.

FIG. 12 illustrates the flow of the correction process. First, in step S1201, the inclination amount S between the print head on the adjustment side and the print head on the reference side is obtained. Next, in step S1202, the positions $A_1$, $A_2$ of the used printing elements that print the printing position adjustment patterns are obtained. In step S1203, Equation 1 above is used to calculate the correction values B. Furthermore, in step S1204, after the saved printing position adjustment value P between different colors for that adjusted color is acquired, that value P is corrected in step S1205 using the correction value B to find P'. By similarly performing this for the print head of other colors, it is possible to find the corrected printing position adjustment value P' between different colors. The correction adjustment value P' is saved in the memory area of the printing apparatus in step 1206. By performing printing using this adjustment value P', it is possible to reduce a printing position shift between different colors that occurs due to relative inclination between print heads.

Equations 1 and 2 are described such that they correspond to the number of nozzles and the shifting direction of the print heads used in the present embodiment. When the number of nozzles mounted in the print heads is different than in the present embodiment, or when the number of nozzles that are mounted in each print head is different, or when the definition of the shifting direction is different, the equations above can be easily changed and optimized for each respective form.

By calculating the correction value as described above from the size of the inclination of the print heads between two head for which printing adjustment is performed, and from the position of the element arrays that print the adjustment patterns, and then correcting the adjustment value according to that correction value, it is possible to reduce the effect of the inclination of the print head and the position of the elements that print the patterns, and it is possible to obtain a more suitable printing position adjustment value.

Embodiment 2

In first embodiment, an arrangement for correcting the printing position adjustment value was described. However, in the second embodiment, instead of correcting the printing position adjustment value, the position of printing elements used for printing the adjustment patterns is changed according to the amount of inclination of the print head so that a more accurate printing position adjustment value is obtained.

As described in detail in the explanation of the first embodiment with reference to FIG. 8, when the printing position is adjusted by using printing elements in the top end region or the bottom end region of the print head so as to print adjustment patterns, it is difficult to properly adjust the printing position when relative inclination occurs between two print heads to be adjusted. Therefore, when relative inclination occurs, it is not preferable to adjust using the top end region or bottom end region. In the present embodiment, in case where it is predicted that due to inclination of the print heads, a printing position shift will occur at an amount equal to or greater than a certain threshold value, that adjustment is performed using the center region of the print heads.

As described in the first embodiment, a deviation of the adjustment value caused by the inclination of the print heads at a position for adjustment with respect to the center region can be expressed by equation 1. As a result of adjustment without correction, the predicted amounts of the printing position shifts between the reference printing element array (black) and the printing element arrays (cyan, magenta, yellow) to be adjusted (that is, a relative inclination between two print heads) can be expressed as B(k)−B(i) (i=C, M, Y). Therefore, for printing element arrays for which this value exceeds a certain threshold value, performing adjustment using the center region of the print heads is preferred.

Figure 14:
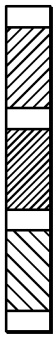
FIG. 14 is a drawing that explains the position of pixel groups that are printed in an adjustment pattern of a second embodiment of the present invention.

The predicted amount of printing position shift and the threshold value will be explained in detail below. The deviation of the adjustment value obtained from Equation 1 is calculated from the position of the printing element group that is used for printing adjustment patterns and from the amount of inclination of the print head. The position of the printing array group can be freely set; however, here, the adjustment pattern is set as illustrated in FIG. 14 by dividing the length of the print head into three regions. When doing this, the center region is located in the exact center of the print heads that the deviation B of the adjustment value becomes 0. Moreover, the top region and the bottom region are symmetrically located with respect to the center, so that the amount of deviation of the adjustment value is the same with only the sign being inverted. Therefore, whether or not the amount of printing position shift caused by inclination of the print heads during adjustment of the print heads using the top region or the bottom region exceeds a threshold value is determined, and when a shift does not exceed the threshold value, printing elements in the top region or bottom region are used to print adjustment patterns and printing position adjustment is performed, and when a shift does exceed the threshold value, printing elements in the center region are used.

Figure 15:
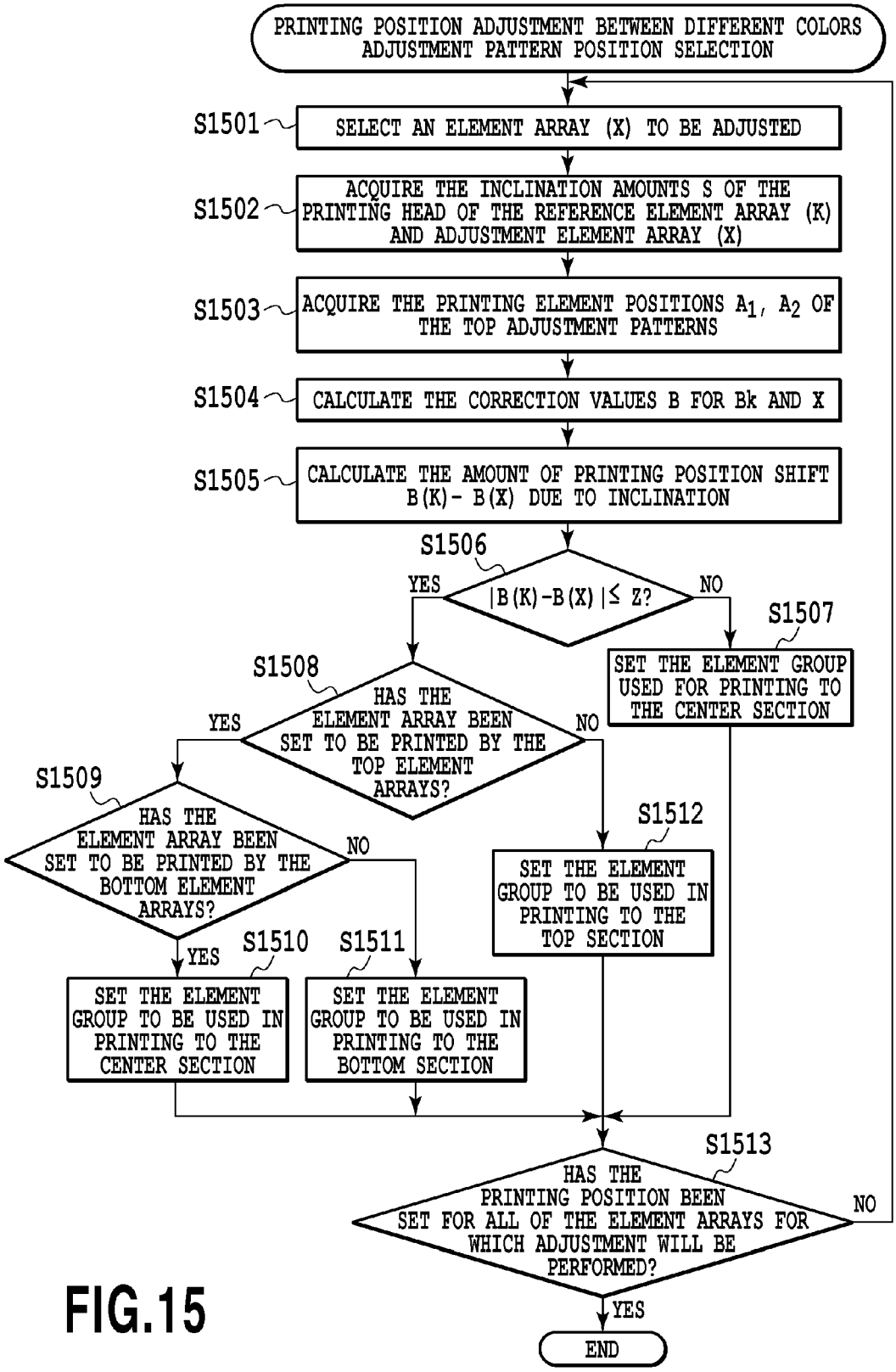
FIG. 15 is a flowchart for explains the processing of a second embodiment of the present invention.

A flow for selecting the position of the element arrays for printing the adjustment patterns will be described with reference to FIG. 15. First, in step S1501, an element array (X in FIG. 15) that selects the position of the adjustment pattern is selected. Next, in step S1502, the inclination amounts S of the print heads of the selected element array and the reference element array (black in this case) are acquired. Then, in step S1503, the used element positions $A_1$, $A_2$ illustrated in FIG. 14 are acquired for the case when the top regions of the print heads are used to print the adjustment patterns. In step 1504, Equation 1 is used to calculate the amounts of shifts B(K) and B(X) of the adjustment values for black and X. Next, in step S1505, the amount of printing position shift B(K)−B(X) caused by inclination of the print heads for black and X is calculated. In step S1506, the amount of printing position shift is compared with a threshold value Z. The method for properly setting the threshold value Z will be described later. When it is determined that the amount of printing position shift is greater than Z, processing advances to step S1507, and for printing element array X, the center region of the printing element array is set to be used for adjustment. When the amount of shift between black and X is small and is determined to be equal to or less than Z, then in step S1508 it is determined whether there is already a printing element array for which adjustment was performed using the top region of the printing element array. When there is no already existing printing element array for which adjustment was performed using the top region of the printing element array, then in step S1512 the top region is set to be used for performing adjustment, and when there is already an existing printing element array, then in step S1509 it is determined whether there exists a printing element array for which adjustment was performed using the bottom region, and when such a printing element array exists, then in step S1510, the center region is set to be used for performing adjustment, and when there is no such printing element array, then in step S1511, the bottom region is set to be used for performing adjustment. Finally, in step S1513, it is determined whether setting the printing element position has been completed for all of the printing element arrays to be used in adjustment and for which the position of the printing elements is to be set, and when setting is not yet finished, processing returns to step S1501 and performs setting for a different printing element array, and when setting is finished, processing ends.

In this embodiment, there where three colors C, M and Y for which adjustment is performed, so that flow is such that when the top region is used, printing is performed using the bottom region. However, in the case of setting the position of the element groups to be used in printing the adjustment patterns for six kinds of element arrays, for example, two kinds of element arrays can be applied for each of the three locations, top region, center region and bottom region, and two lines can be printed.

Moreover, in the present embodiment, the position of the element arrays used in adjustment was divided into three regions, and because the top region and the bottom region are symmetrically located, comparison of the amount of printing position shift is performed only once. However, the position can be divided into five divisions, or four regions having different widths, and in that case, more complicated processing flow is necessary for determining which position is suitable to be set.

Next, a method for properly setting the threshold value Z above will be explained. The threshold value Z is a value used in determining whether the deviation in the adjustment value between printing element arrays caused by inclination of print heads is large or small, so can be set according to the required adjustment precision. For example, in the present embodiment, the printing resolution in printing position adjustment between printing element arrays is 1200 dpi, and the adjustment resolution is 4800 dpi. Therefore, there may be always approximately 5.3 μm of error as quantization error. Taking into consideration the shift that occurs when determining the amount of dispersion in adjustment or the amount of inclination when performing printing position adjustment, the threshold value Z should be preferably set so that the necessary precision is obtained. Changing the threshold value Z according to conditions such as the type of paper used during adjustment and the distance between the print head and the paper is also effective.

Figure 13A:
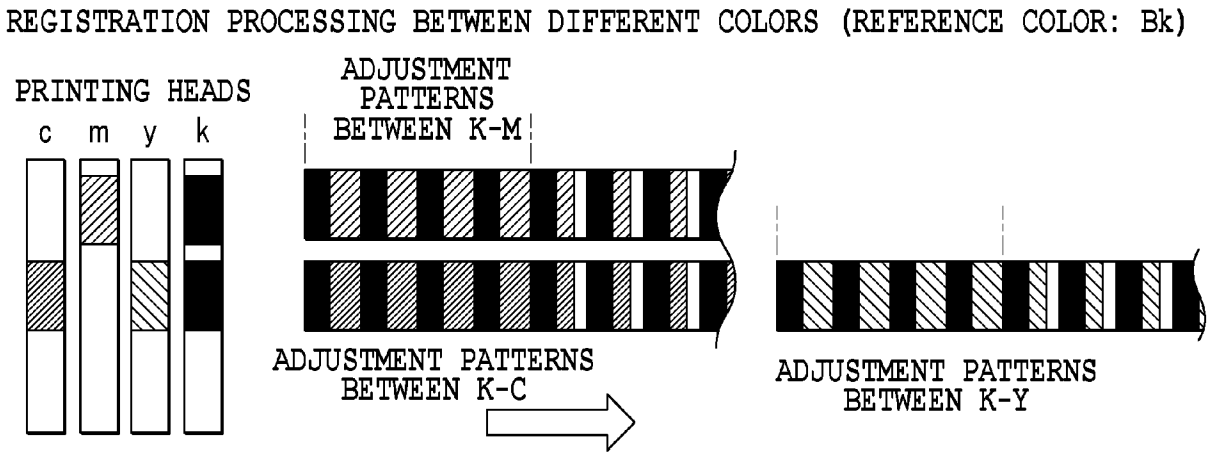
FIGS. 13A and 13B are views for explaining a second embodiment according to the printing method of the present invention.
Figure 13B:
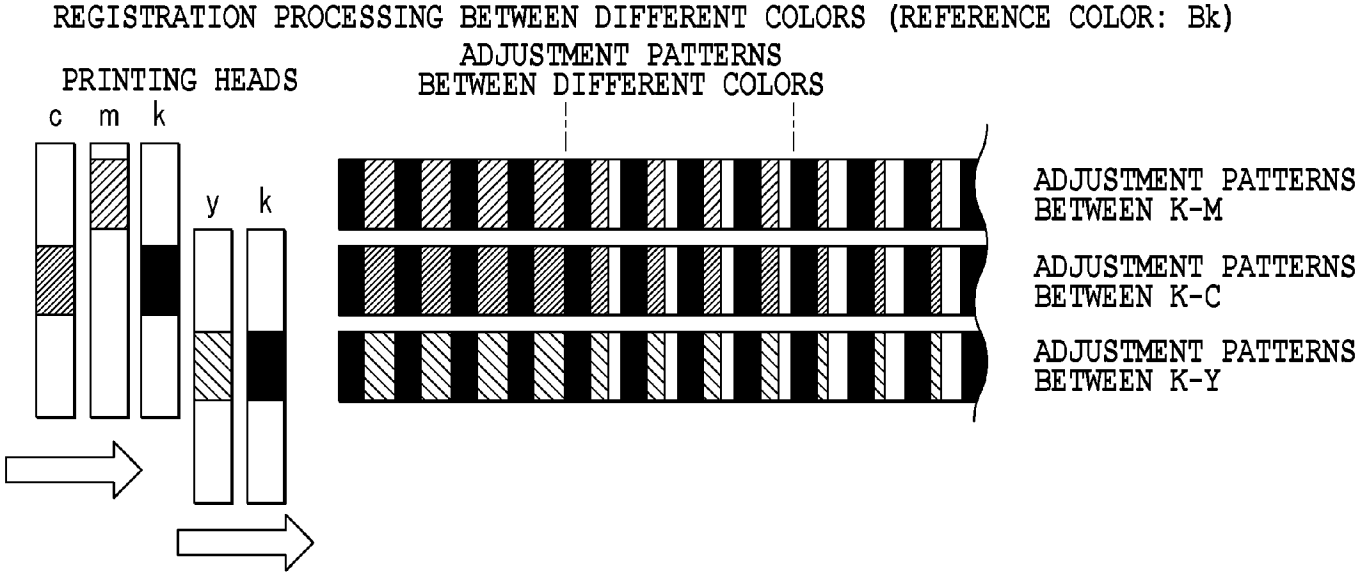

FIGS. 13A and 13B illustrate an example of the printing method in the case of using the center region of the print head to perform adjustment of the printing element arrays for cyan and yellow. In FIG. 13A, the paper is not conveyed and the cyan and yellow adjustment patterns that were printed using the center area of the print heads are arranged in the main scanning direction. FIG. 13B illustrates the state between printing cyan and yellow adjustment patterns when the paper is conveyed. The case illustrated in FIG. 13A has the advantage in that the scans by the print head can be completed in one scan, and the amount of paper used in the sub scanning direction can be reduced. However, a certain amount of paper width in the main scanning direction is necessary. In the case of FIG. 13B, not so much paper width is necessary; however, it is necessary to convey the paper, so that its weaknesses are that the number of scans by the print heads is increased, and adjustment takes a longer amount of time. Which printing method to select should preferably be set by taking into consideration the size of the adjustment patterns with respect to the paper width, and the throughput required for adjustment. It is also possible to change the setting for each condition, or to use an optimized third printing method.

As described above, by changing the position of the printing elements in each print head that are used in printing adjustment patterns according to the amount of printing position shift caused by relative inclination between print heads for which printing position adjustment is performed, it is possible to obtain higher printing position adjustment precision.

Embodiment 3

In the second embodiment, when there was a large amount of shift caused by relative inclination of the print heads, the position of the element groups used for printing the adjustment patterns was the center region. In this embodiment, construction is such that, using the same judgment, when a deviation of printing position adjustment value is large, an adjustment pattern is added that will correct that deviation.

In FIG. 16, 1601 indicates a table indicating the positions of printing element groups that are used in this embodiment for printing position adjustment of the yellow, magenta and cyan printing element arrays. In this embodiment, when the amount of printing position shift, which is calculated from the amount of inclination of the print head and the position of the element array that prints the adjustment pattern used, exceeds a threshold value, an additional correction pattern is printed using element groups at symmetric positions with respect to the center of the printing element arrays, an adjustment value is obtained, and the average with the adjustment value obtained from the previously printing adjustment pattern is taken to be the final adjustment value. In the figure, 1602 indicates the positions of element groups at symmetric positions with respect to the center of the printing element arrays, and these element arrays are used when printing the correction patterns.

Figure 17:
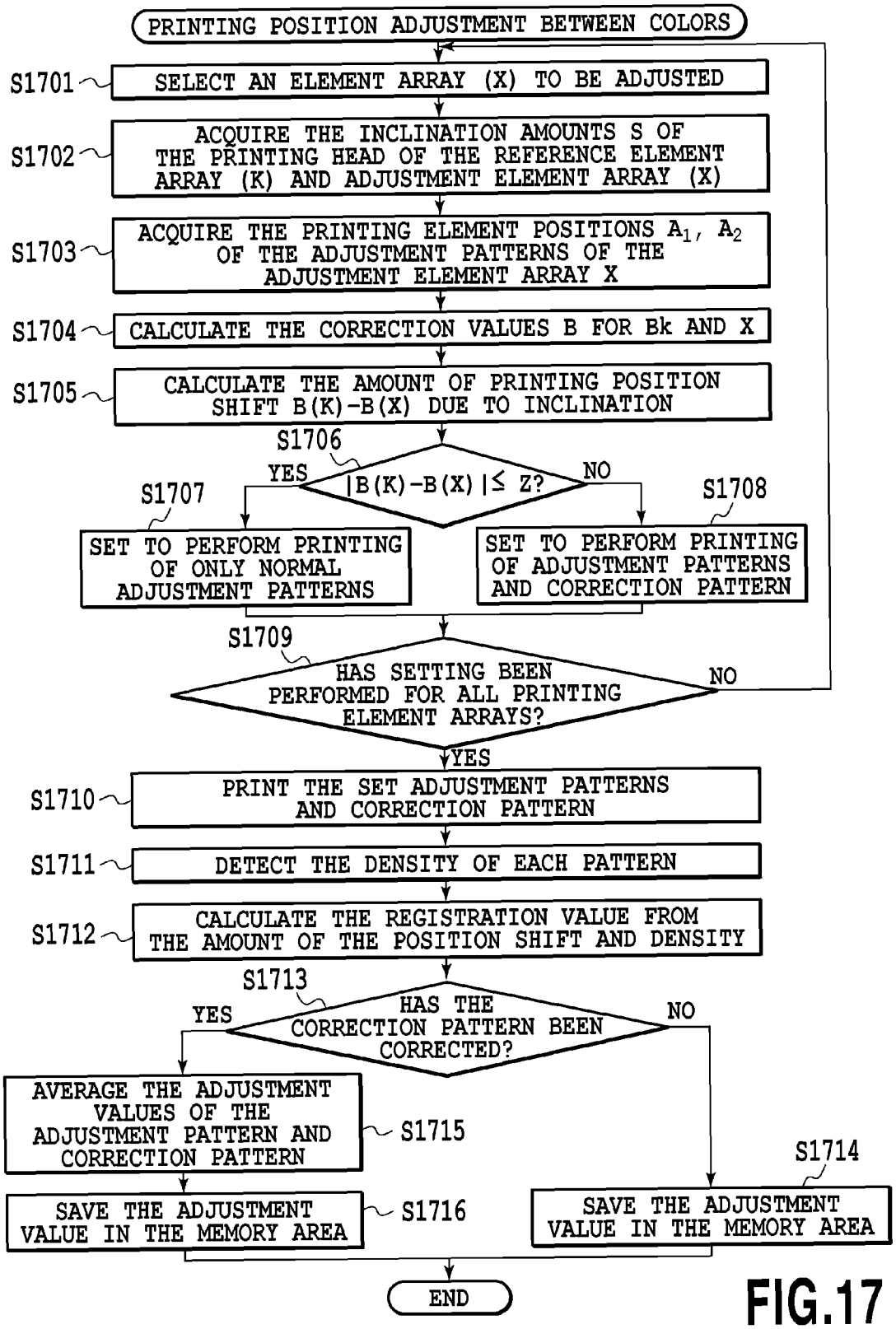
FIG. 17 is a flowchart that explains the processing of a third embodiment of the present invention.

FIG. 17 is a view illustrating the processing flow of this embodiment. First, in step S1701, an element array (X in the figure) for which adjustment is to be performed is selected, and in step 1702, the inclination amounts S of the print heads of the selected element array and the reference element array (black in this case) are acquired. Furthermore, in step S1703, position $A_1$ and $A_2$ of the element arrays that will print the adjustment patterns are acquired, and in step S1704, the amounts of shift B(K) and B(X) of the adjustment value for black and X are calculated using Equation 1, and then in step S1705, the amount of printing position shift B (K)−B (X) due to inclination of the print heads between black and X is calculated. In step S1706, the amount of printing position shift is compared with a threshold value Z. The method for properly setting the value of this threshold value Z is as described above. When it is determined that the size of the amount of printing position shift is less than the threshold value Z, processing advances to step S1707, and setting is performed so that only the printing element array of the normal position that was set is used for printing the adjustment patterns. In step S1706, when it is determined that the size of the amount of printing position shift is greater than the threshold value Z, then in step S1710, setting is performed so that in addition to printing by the printing element array at the set position, printing is performed of a correction pattern that uses printing elements arrays at symmetric positions with respect to the center of the print head. Next, in step S1713, it is determined whether the setting of whether to print the correction pattern for all printing element arrays is finished, and when the setting is not finished, processing returns to step S1701, and when the setting is finished, processing advances to step S1710. In step S1710, printing of the patterns set for each of the printing element arrays is performed. Then, in step S1711, the density of the printed adjustment patterns and the correction pattern is detected, and in step S1712, the printing position adjustment value is calculated from the patterns. When the printed patterns are only the adjustment patterns, only that adjustment value is calculated, and when the adjustment patterns and correction pattern are printed, both adjustment values are calculated. Next, in step S1713, judgment is performed for each printing element array to determine whether or not a correction pattern was printed. When printing of the correction pattern is not performed, then in step S1714, the calculated adjustment value is stored as is in the memory area, and when the correction pattern is printed, then in step S1715, the average value of the adjustment value that was calculated from the adjustment patterns and the adjustment value that was calculated from the correction pattern is found. After that, in step S1716, the average value is stored in the memory area as the final adjustment value.

Figure 18:
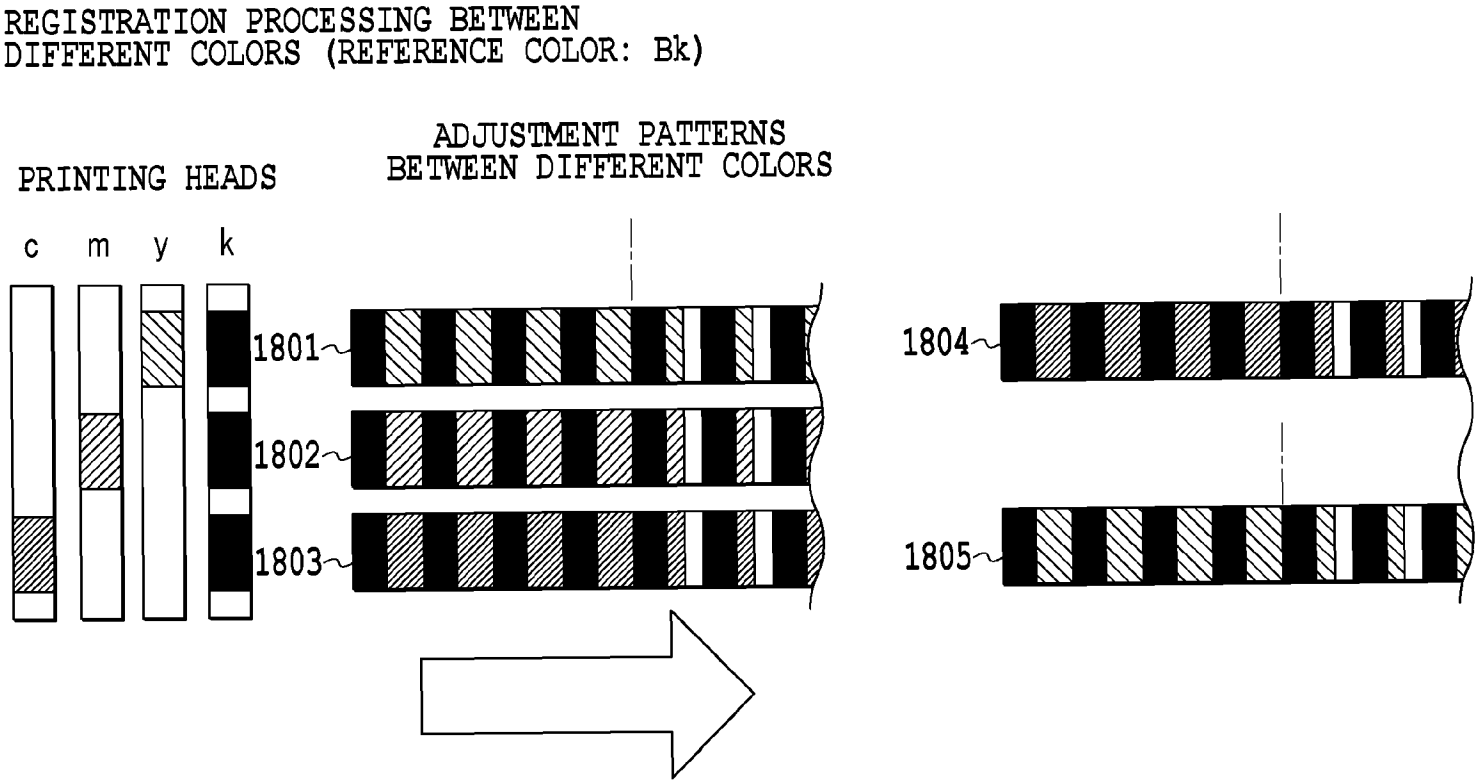
FIG. 18 is a view for explaining a third embodiment according to the printing method of the present invention.

FIG. 18 illustrates an example of a printing method in the case when the amounts of shift of the cyan and yellow printing element arrays exceed a threshold value. In the figure, 1801, 1802 and 1803 indicate the patterns that were printed using the element groups at the positions normally set for yellow, magenta and cyan, and 1804 and 1805 indicate the correction patterns that are printed using element groups that are at symmetrical positions with respect to the center position of the print head. Here, the correction patterns are printed next to the normal patterns; however, as illustrated in FIG. 13B, it is possible to print by a plurality of scans that includes suitable conveyance of the paper.

As described above, by determining the amount of printing position shift from the inclination of the print heads and the position of the printing element groups that print the adjustment patterns, it is possible to obtain adjustment values that can more accurately set the printing position.

In the embodiments 1 to 3 above, the explanation centered mainly on a printing position shift between different colors; however, needless to say the same effect is obtained in the case of element arrays of the same color that have different inclinations. Moreover, the amount of inclination was detected for all element arrays; however, in the case of a plurality of element arrays in the same print head, it is possible to detect the amount of inclination of one of those arrays, and presume that the other element arrays in the same print head have the same amount of inclination.

In the printing apparatus, of the two printing operations that are the object of the registration adjustment process, the timing of one of the printing operations is controlled, and an adjustment value for aligning the printing positions of the two printing operations is saved. In the case where this adjustment value does not need to be updated, the adjustment value can be set as a default value during the inspection process at the factory at the time of shipping, and ROM that stores that value can be mounted in the printing apparatus. However, when the registration process is performed according to an instruction from a user, or by a repairperson or by taking the printing apparatus to a repair center, by storing the adjustment value in an EEPROM, the value can be suitably updated. In this case, the timing of one printing operation is controlled based on the adjustment value stored in the printing apparatus and an adjustment pattern is printed, and timing information for a printing operation that will minimize a relative position shift in elements is obtained. Then, a new adjustment value is set based on the printing timing that minimizes the amount of shifting from the printing timing when printing the adjustment patterns and that adjustment value is stored in the EEPROM. In either case, the adjustment value is referenced as a printing timing correction value when printing an image.

The configuration and number of nozzle arrays or print heads described above, and the kinds and number of ink colors are only examples, and needless to say that any appropriate ones could be used. For example, in the example above, a form of using the four colors Bk, C, M and Y was presented; however, a form of also using special colors such as light cyan and like magenta having a low density, or using red and green is also possible. In addition, in each of the embodiments above, the case of applying the present invention to an inkjet printing apparatus that forms images by discharging ink from print heads onto a print medium was explained. However, the present invention can be applied to any kind of printing apparatus regardless of type as long as dots are formed and printed while there is relative movement between the print head and printing paper.

Moreover, an example of detecting the density using an optical sensor was given as the method for detecting shifting of the printing position adjustment patterns; however, the construction of the present invention is not limited to this. Construction is also possible in which the user visually selects an optimum pattern and acquires an adjustment value by inputting the selected pattern.

In the embodiments above, an example of the case of using inkjet printing elements as the printing elements was presented; however it is also possible to apply the present invention to elements other than inkjet printing elements as long as the printing elements can print dots.

In the embodiments above, an example of a printer that causes the print heads to scan in a main scanning direction and conveys the print medium in a sub scanning direction was given; however the present invention is not limited to this and can also be applied to a so-called line type inkjet printer.

In the above second embodiment, in case where a relative inclination between two print heads is equal to or smaller than a threshold value, top end region or bottom end region of the printing heads are selected as a partial region for printing an adjustment pattern, and in case where the relative inclination between two print heads is greater than the threshold value, center regions of the print heads are selected as the partial region for printing an adjustment pattern. However, the present invention is not limited to this configuration. For example, a configuration can be employed as below. A relative inclination of the printing element array for cyan with respect to the printing element array for black is compared with a relative inclination of the printing element array for yellow with respect to the printing element array for black. Next, in case where the relative inclination of the printing element array for cyan is smaller than the relative inclination of the printing element array for yellow, center regions of the printing element arrays for yellow and black are selected as a first partial region and top end region or bottom end region of the printing element arrays for cyan and black are selected as a second partial region. Contrary, in case where the relative inclination of the printing element array for cyan is greater than the relative inclination of the printing element array for yellow, center regions of the printing element arrays for cyan and black are selected as a first partial region and top end region or bottom end region of the printing element arrays for yellow and black are selected as a second partial region.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-000628, filed Jan. 5, 2011, which is hereby incorporated by reference herein in its entirety.

What is claimed is:

1. A printing apparatus, comprising:

a print unit, comprising:

a first print head that includes a first printing element array formed by first printing elements configured to print first dots, and a second print head that includes a second printing element array formed by second printing elements configured to print second dots;

a scan unit configured to scan the print unit in a scan direction;

an adjustment pattern printing control unit configured to control the print unit to print a plurality of adjustment patterns on a print medium using (i) a first printing element, of the first printing elements, disposed in an adjustment pattern printing area of the first printing element array, and (ii) a second printing element, of the second printing elements, disposed in an adjustment pattern printing area of the second printing element array, wherein a position of the first printing element within the first printing element array corresponds to a position of the second printing element within the second printing element array, wherein the adjustment pattern printing area of the first printing element array does not include a center of the first printing element array, and the adjustment pattern printing area of the second printing element array does not include a center of the second printing element array, and wherein the adjustment pattern printing control unit controls the print unit to print the plurality of adjustment patterns in one scan by the scan unit;

an adjustment value determination unit configured to determine an adjustment value for the second printing element array relative to the first printing element array based on the plurality of the adjustment patterns;

an inclination acquisition unit configured to acquire a first inclination amount of the first printing element array and a second inclination amount of the second printing element array;

a first correction value acquisition unit configured to acquire a first correction value based on the first inclination amount of the first printing element array and the position of the adjustment pattern printing area of the first printing element array;

a second correction value acquisition unit configured to acquire a second correction value based on the inclination amount of the second printing element array and the position of the adjustment pattern printing area of the second printing element array;

a correction unit configured to correct the adjustment value, calculated by the adjustment value determination unit, by using the first correction value and the second correction value; and a print control unit configured to control printing of an image in accordance with the corrected adjustment value, corrected by the correction unit.

2. The printing apparatus of claim 1, wherein the plurality of adjustment patterns are printed using a plurality of the first printing elements, disposed in the adjustment pattern printing area of the first printing element array, and a plurality of the second printing elements, disposed in the adjustment pattern printing area of the second printing element array.

3. The printing apparatus of claim 1, wherein the first dots and the second dots are of different colors.

4. The printing apparatus of claim 1, wherein each of the plurality of adjustment patterns includes a first pattern printed by the first printing element disposed in the adjustment pattern printing area of the first printing element array, and a second pattern printed by the second printing element disposed in the adjustment pattern printing area of the second printing element array.

5. The printing apparatus of claim 4, wherein a shift amount between the first pattern and the second pattern, in the scan direction, is different in each of the plurality of adjustment patterns.

6. The printing apparatus of claim 1, wherein the adjustment value determination unit comprises an optical sensor, and is further configured to determine the adjustment value based on optical reflectance information obtained by detecting the plurality of the adjustment patterns with the optical sensor.

7. The printing apparatus of claim 1, wherein the inclination acquisition unit is further configured to:

(i) acquire the first inclination amount based on a plurality of first printing patterns printed by the first printing element array, each of the plurality of first printing patterns including a first reference pattern printed by a printing element, of the first printing elements, arranged at a top edge portion of the first printing element array, and a corresponding first non-reference pattern printed by a printing element, of the first printing elements, arranged at a bottom edge portion of the first printing element array, and (ii) acquire the second inclination amount based on a plurality of second printing patterns printed by the second printing element array, each of the plurality of printing patterns including a second reference pattern printed by a printing element, of the second printing elements, arranged at a top edge portion of the second printing element array, and a corresponding second non-reference pattern printed by a printing element, of the second printing elements, arranged at a bottom edge portion of the second printing element array.

8. The printing apparatus of claim 7, wherein the inclination acquisition unit acquires (i) the first inclination amount by identifying a first reference pattern and a corresponding first non-reference pattern which lie substantially on a same line, and (ii) the second inclination amount by identifying a second reference pattern and a corresponding second non-reference pattern which lie substantially on a same line.

9. The printing apparatus of claim 7, wherein a printing position between the reference pattern and the corresponding non-reference pattern in each of the plurality of first printing patterns is different, and wherein a printing position between the reference pattern and the corresponding non-reference pattern in each of the plurality of second printing patterns is different.

10. The printing apparatus of claim 1, wherein the adjustment pattern printing control unit prints the plurality of adjustment pattern while the scan unit scans.

11. A control method for a printing apparatus that prints an image, the print unit comprising a first print head that includes a first printing element array formed by first printing elements configured to print first dots, and a second print head that includes a second printing element array formed by second printing elements configured to print second dots, the control method comprising:

an adjustment pattern printing step of printing a plurality of adjustment patterns on a print medium by scanning the print unit and (i) ejecting first dots from a first printing element, of the first printing elements, disposed in an adjustment pattern printing area of the first printing element array which does not include a center of the first printing element array, and (ii) ejecting second dots from a second printing element, of the second printing elements, disposed in an adjustment pattern printing area of the second printing element array which does not include a center of the second printing element array, wherein a position of the first printing element within the first printing element array corresponds to a position of the second printing element within the second printing element array, and wherein the plurality of adjustment patterns are printed in one scan by the scan unit;

an adjustment value determination step of determining an adjustment value for the second printing element array relative to the first printing element array based on the plurality of the adjustment patterns;

an inclination acquisition step of acquiring a first inclination amount of the first printing element array and a second inclination amount of the second printing element array;

a first correction value acquisition step of acquiring a first correction value based on the first inclination amount of the first printing element array and the position of the adjustment pattern printing area of the first printing element array;

a second correction value acquisition step of acquiring a second correction value based on the inclination amount of the second printing element array and the position of the adjustment pattern printing area of the second printing element array;

a correction step of correcting the adjustment value, calculated in the adjustment value determination step, by using the first correction value and the second correction value; and a print control step of controlling printing of an image in accordance with the corrected adjustment value, corrected in the correction step.

12. The control method of claim 11, wherein the plurality of adjustment patterns are printed by ejecting first dots from a plurality of the first printing elements, disposed in the adjustment pattern printing area of the first printing element array, and by ejecting second dots from a plurality of the second printing elements, disposed in the adjustment pattern printing area of the second printing element array.

13. The control method of claim 11, wherein the first dots and the second dots are of different colors.

14. The control method of claim 11, wherein each of the plurality of adjustment patterns includes a first pattern printed by the first printing element disposed in the adjustment pattern printing area of the first printing element array, and a second pattern printed by the second printing element disposed in the adjustment pattern printing area of the second printing element array.

15. The control method of claim 14, wherein a shift amount between the first pattern and the second pattern, in the scan direction, is different in each of the plurality of adjustment patterns.

16. The control method of claim 1, wherein the adjustment value is determined based on optical reflectance information obtained by detecting the plurality of the adjustment patterns with an optical sensor.

17. The control method of claim 11, wherein the first inclination amount is acquired, in the inclination acquisition step, based on a plurality of first printing patterns printed by the first printing element array, each of the plurality of first printing patterns including a first reference pattern printed by a printing element, of the first printing elements, arranged at a top edge portion of the first printing element array, and a corresponding first non-reference pattern printed by a printing element, of the first printing elements, arranged at a bottom edge portion of the first printing element array, and wherein the second inclination amount is acquired, in the inclination acquisition step, based on a plurality of second printing patterns printed by the second printing element array, each of the plurality of printing patterns including a second reference pattern printed by a printing element, of the second printing elements, arranged at a top edge portion of the second printing element array, and a corresponding second non-reference pattern printed by a printing element, of the second printing elements, arranged at a bottom edge portion of the second printing element array.

18. The control method of claim 17, wherein the first inclination amount is acquired, in the inclination acquisition step, by identifying a first reference pattern and a corresponding first non-reference pattern which lie substantially on a same line, and (ii) the second inclination amount is acquired, in the inclination acquisition step, by identifying a second reference pattern and a corresponding second non-reference pattern which lie substantially on a same line.

19. The control method of claim 17, wherein a printing position between the reference pattern and the corresponding non-reference pattern in each of the plurality of first printing patterns is different, and wherein a printing position between the reference pattern and the corresponding non-reference pattern in each of the plurality of second printing patterns is different.

20. A printing apparatus, comprising:

a print unit, comprising:

a first printing element array formed by first printing elements arrayed in a predetermined direction and configured to print first dots, and a second printing element array formed by second printing elements arrayed in the predetermined direction and configured to print second dots;

a scan unit configured to scan the print unit in a scan direction intersecting the predetermined direction;

an adjustment pattern printing control unit configured to control the print unit to print an adjustment pattern on a print medium using (i) a first printing element, of the first printing elements, disposed in an adjustment pattern printing area of the first printing element array, and (ii) a second printing element, of the second printing elements, disposed in an adjustment pattern printing area of the second printing element array;

an adjustment value obtaining unit configured to obtain an adjustment value relating the adjustment pattern used for adjusting a relative print position between the first printing element array and the second printing element array in the scan direction;

an inclination information acquisition unit configured to acquire inclination information representing a first inclination amount of the first printing element array and a second inclination amount of the second printing element array;

a correction unit configured to correct the adjustment value, obtained by the adjustment value obtaining unit, based on the inclination represented by the inclination information acquired by the inclination information acquisition unit; and a print control unit configured to control printing of an image by the printing unit by (i) adjusting a relative print position of the first printing elements among the first printing element array based on the first inclination amount, (ii) adjusting a relative print position of the second printing elements among the second printing element array based on the second inclination amount, and (iii) adjusting the relative print position between the first printing element array and the second printing element array based on the adjustment value corrected by the correction unit.

21. The printing apparatus of claim 20, wherein the adjustment pattern is printed using a plurality of the first printing elements, disposed in the adjustment pattern printing area of the first printing element array, and a plurality of the second printing elements, disposed in the adjustment pattern printing area of the second printing element array.

22. The printing apparatus of claim 20, wherein the first dots and the second dots are of different colors.

23. The printing apparatus of claim 20, wherein the adjustment pattern includes a plurality of adjustment patterns each of which includes a first pattern printed by the first printing element disposed in the adjustment pattern printing area of the first printing element array, and a second pattern printed by the second printing element disposed in the adjustment pattern printing area of the second printing element array.

24. The printing apparatus of claim 23, wherein a shift amount between the first pattern and the second pattern, in the scan direction, is different in each of the plurality of adjustment patterns.

25. The printing apparatus of claim 20, wherein the adjustment value obtaining unit comprises an optical sensor, and is further configured to obtain the adjustment value based on optical reflectance information obtained by measuring the adjustment pattern with the optical sensor.

26. The printing apparatus of claim 20, wherein the inclination information acquisition unit is further configured to:

(i) acquire the first inclination amount relating a plurality of first printing patterns printed by the first printing element array, each of the plurality of first printing patterns including a first reference pattern printed by a printing element, of the first printing elements, arranged at a top edge portion of the first printing element array, and a corresponding first non-reference pattern printed by a printing element, of the first printing elements, arranged at a bottom edge portion of the first printing element array, and (ii) acquire the second inclination amount relating a plurality of second printing patterns printed by the second printing element array, each of the plurality of second printing patterns including a second reference pattern printed by a printing element, of the second printing elements, arranged at a top edge portion of the second printing element array, and a corresponding second non-reference pattern printed by a printing element, of the second printing elements, arranged at a bottom edge portion of the second printing element array.

27. The printing apparatus of claim 26, wherein the inclination information acquisition unit acquires (i) the first inclination amount by identifying a first reference pattern and a corresponding first non-reference pattern which lie substantially on a same line, and (ii) the second inclination amount by identifying a second reference pattern and a corresponding second non-reference pattern which lie substantially on a same line.

28. The printing apparatus of claim 26, wherein a printing position between the reference pattern and the corresponding non-reference pattern in each of the plurality of first printing patterns is different, and wherein a printing position between the reference pattern and the corresponding non-reference pattern in each of the plurality of second printing patterns is different.

29. The printing apparatus of claim 20, wherein the adjustment pattern printing control unit prints an adjustment pattern by the first printing element in a scan for one scan direction and by the second printing element in a scan for the one scan direction.

30. The printing apparatus of claim 20, wherein the adjustment value obtaining unit obtains the adjustment value based on input by a user.

31. The printing apparatus of claim 20, wherein the inclination information acquisition unit acquires the inclination information based on input by a user.

32. A control method for a printing apparatus that prints an image, the printing apparatus includes a printing unit comprising a first printing element array formed by first printing elements arrayed in a predetermined direction and configured to print first dots, and a second printing element array formed by second printing elements arrayed in the predetermined direction and configured to print second dots, the control method comprising:

an adjustment pattern printing step of printing an adjustment pattern on a print medium using (i) a first printing element, of the first printing elements, disposed in an adjustment pattern printing area of the first printing element array, and (ii) a second printing element, of the second printing elements, disposed in an adjustment pattern printing area of the second printing element array;

an adjustment value obtaining step of obtaining an adjustment value relating the adjustment pattern used for adjusting a relative print position between the first printing element array and the second printing element array in the scan direction;

an inclination information acquisition step of acquiring inclination information representing a first inclination amount of the first printing element array and a second inclination amount of the second printing element array;

a correction step of correcting the adjustment value, obtained in the adjustment value obtaining step, based on the inclination represented by the inclination information acquired in the inclination information acquisition step; and a print control step of controlling printing of an image by the printing unit by (i) adjusting a relative print position of the first printing elements among the first printing element array based on the first inclination amount, (ii) adjusting a relative print position of the second printing elements among the second printing element array based on the second inclination amount, and (iii) adjusting the relative print position between the first printing element array and the second printing element array based on the adjustment value corrected in the correction step.

33. The control method of claim 32, wherein the adjustment pattern is printed by ejecting first dots from a plurality of the first printing elements, disposed in the adjustment pattern printing area of the first printing element array, and by ejecting second dots from a plurality of the second printing elements, disposed in the adjustment pattern printing area of the second printing element array.

34. The control method of claim 32, wherein the first dots and the second dots are of different colors.

* * * * *